US006648751B1

(12) United States Patent
Pong

(10) Patent No.: US 6,648,751 B1
(45) Date of Patent: Nov. 18, 2003

(54) AIRFLOW BALANCER FOR VENTILATION OUTLET

(76) Inventor: Juni Pong, 11900 McGirk Ave., El Monte, CA (US) 91732

( * ) Notice: Subject to any disclaimer, the term of this patent is extended or adjusted under 35 U.S.C. 154(b) by 0 days.

(21) Appl. No.: 10/162,254

(22) Filed: Jun. 5, 2002

(51) Int. Cl.[7] ..... F24F 13/06
(52) U.S. Cl. ..... 454/297; 454/285; 454/299
(58) Field of Search ..... 454/285, 292, 454/297, 299, 300

(56) References Cited

U.S. PATENT DOCUMENTS 2,824,429 A * 2/1958 Zucker ..... 62/427
4,425,840 A * 1/1984 Masao ..... 454/338
4,616,563 A * 10/1986 Toohey ..... 454/285
4,878,620 A * 11/1989 Tarleton ..... 239/383
5,833,530 A * 11/1998 Kuo ..... 454/285

* cited by examiner

*Primary Examiner*—Harold Joyce
(74) *Attorney, Agent, or Firm*—Raymond Y. Chan; David and Raymond Patent Group

(57) ABSTRACT

An airflow balancer for mounting on a ventilation outlet includes an air guider including a supporter having a bottom surface for rotatably supporting on the ventilation outlet and an airflow baffle coaxially mounted to the supporter such that the airflow baffle is suspendedly supported on the ventilation outlet. The airflow baffle has a plurality of ventilating slots for allowing an airflow passing therethrough and a rotor coaxially mounted on the air guider. The rotor is shaped and sized such that, in response to the airflow passing through the rotor, the rotor is driven to rotate, so as to drive the air guider to rotate, wherein a rotational movement of the air guider is adapted for evenly diffusing the airflow through the ventilating slots toward the ventilation outlet.

55 Claims, 7 Drawing Sheets

AIRFLOW BALANCER FOR VENTILATION OUTLET

BACKGROUND OF THE INVENTION

1. Field of Invention

The present invention relates to a ventilation device, and more particularly to an inexpensive airflow balancer for a ventilation outlet, which can ensure the outlet air evenly flowing through the ventilation outlet.

2. Description of Related Arts

Nowadays, ventilation system plays a main role for all modern buildings such as office and home to be well ventilated in order to provide a comfortable indoor climate condition for the residents. For example, the resident is able to turn on the air conditioning during the summer time and the heater during the wintertime, so as to set an acceptable indoor climate condition. General speaking, the ventilation system generates a flow of cool or hot air to each room of the building through a ventilation outlet mounted on a ceiling, wall or roof of each room of the building.

When the ventilation system is pre-set at a predetermined temperature, especially the central control ventilation system, the ventilation system generates the same amount of airflow directly exhausted through the ventilation outlets to the rooms of the building respectively. As a result, the ventilation system may not be sufficient to properly ventilate the much bigger room of the building. To deal with this problem, the ventilation system must be set to generate a larger airflow and the ventilation outlet can be selectively opened and closed to admit ventilating air into the room when desired. In other words, the resident is able to fully open the ventilation outlet that allows more air flowing into the larger room and partially close the ventilation outlet to block the air flowing into the smaller room. However, such method is practiced in the art but do not work as a cost effective and energy efficient way.

Moreover, the resident may feel uncomfortable when he or she sits right under the ventilation outlet such that the airflow will directly blow towards the resident. However, the airflow may hardly reach the area that far from the ventilation outlet. Therefore, it is an important consideration when designing the location of the ventilation outlet for each room that the airflow can be evenly distributed to every corner of the room while being cost effective and energy efficient.

Although it is possible to install an electric fan at each ventilation outlet to evenly blow the airflow therethrough, it is not practical because:

(i) it is too troublesome in installation;

(ii) electric power is required by extending electric cords to every ventilation outlet;

(iii) extra power switches are required to control the on/off of the electric fans;

(iv) expensive and heavy motor is required to drive the fan to rotate; and (v) it is difficult to mount and install at existing ventilation outlets.

SUMMARY OF THE PRESENT INVENTION

A main object of the present invention is to provide an airflow balancer for a ventilation outlet, which can guide and evenly distribute a flow of air through the ventilation outlet while being cost effective and energy efficient.

Another object of the present invention is to provide an airflow balancer for a ventilation outlet, wherein the airflow balancer is automatically driven by the out flowing of air generated by the ventilation system, such that no electric is needed to propelled the airflow balancer of the present invention so as to substantially save the additional cost and energy associated with the present invention.

Another object of the present invention is to provide an airflow balancer for a ventilation outlet, wherein the airflow balancer automatically stops when the ventilation system stops.

Another object of the present invention is to provide an airflow balancer for a ventilation outlet, wherein the user may select the airflow balancer to functions and works automatically whenever the ventilation system is working or not to function anytime.

Another object of the present invention is to provide an airflow balancer for a ventilation outlet, wherein the airflow is guided to enter into the room through the ventilation outlet in a circular motion such that the airflow balancer is adapted to direct the airflow to evenly spread out in the entire room. In other words, the resident will not feel uncomfortable even though he or she sits right under the ventilation outlet.

Another object of the present invention is to provide an airflow balancer for a ventilation outlet, wherein the installation operation of the airflow balancer is simple and fast that one individual is able to self-install the airflow balancer to the ordinary ventilation outlet by simply mounting to the ventilation outlet.

Another object of the present invention is to provide an airflow balancer for a ventilation outlet, wherein the airflow balancer can be built in a new type of ventilation outlet for new construction. The user may also replace the ventilation outlet manufactured to have the airflow balancer of the present invention.

Another object of the present invention is to provide a airflow balancer for a ventilation outlet, wherein the rotational speed of the airflow balancer is adapted to be selectively adjusted in order to control the amount of the airflow entering into the room, such that the airflow balancer can be set to have a higher rotational speed to allow a higher circulating speed of the airflow, such as for a larger room, and set to have a lower rotational speed to allow a lower circulating speed of the airflow, such as for a smaller room. In other words, no matter the resident stay in a larger room or a smaller room, the ventilation system is adapted to supply sufficient airflow to the room by controlling the speed of the airflow balancer.

Another object of the present invention is to provide an airflow balancer for a ventilation outlet, wherein no expensive or complicated part is required to employ in the present invention in order to achieve the above mentioned objects. Therefore, the present invention successfully provides an economic and efficient solution for permitting ventilating air to evenly diffuse to the room through the ventilation outlet.

Accordingly, in order to accomplish the above objects, the present invention provides an airflow balancer for a ventilation outlet, which comprises:

an air guider comprising an airflow baffle which has a plurality of ventilating slots for allowing an airflow passing through and a supporter provided at a center of the airflow baffle for suspendedly supporting the airflow baffle on the ventilation outlet in a rotatable manner; and a rotor coaxially and upwardly extended from the air guider and arranged in responsive to a breeze blowing of the airflow passing through the rotor so as to drive the airflow baffle to rotate, in such a manner that a rotational movement of the air guider is adapted for evenly diffusing the airflow through the ventilating slots toward the ventilation outlet.

DETAILED DESCRIPTION OF THE PREFERRED EMBODIMENTS

Figure 1:
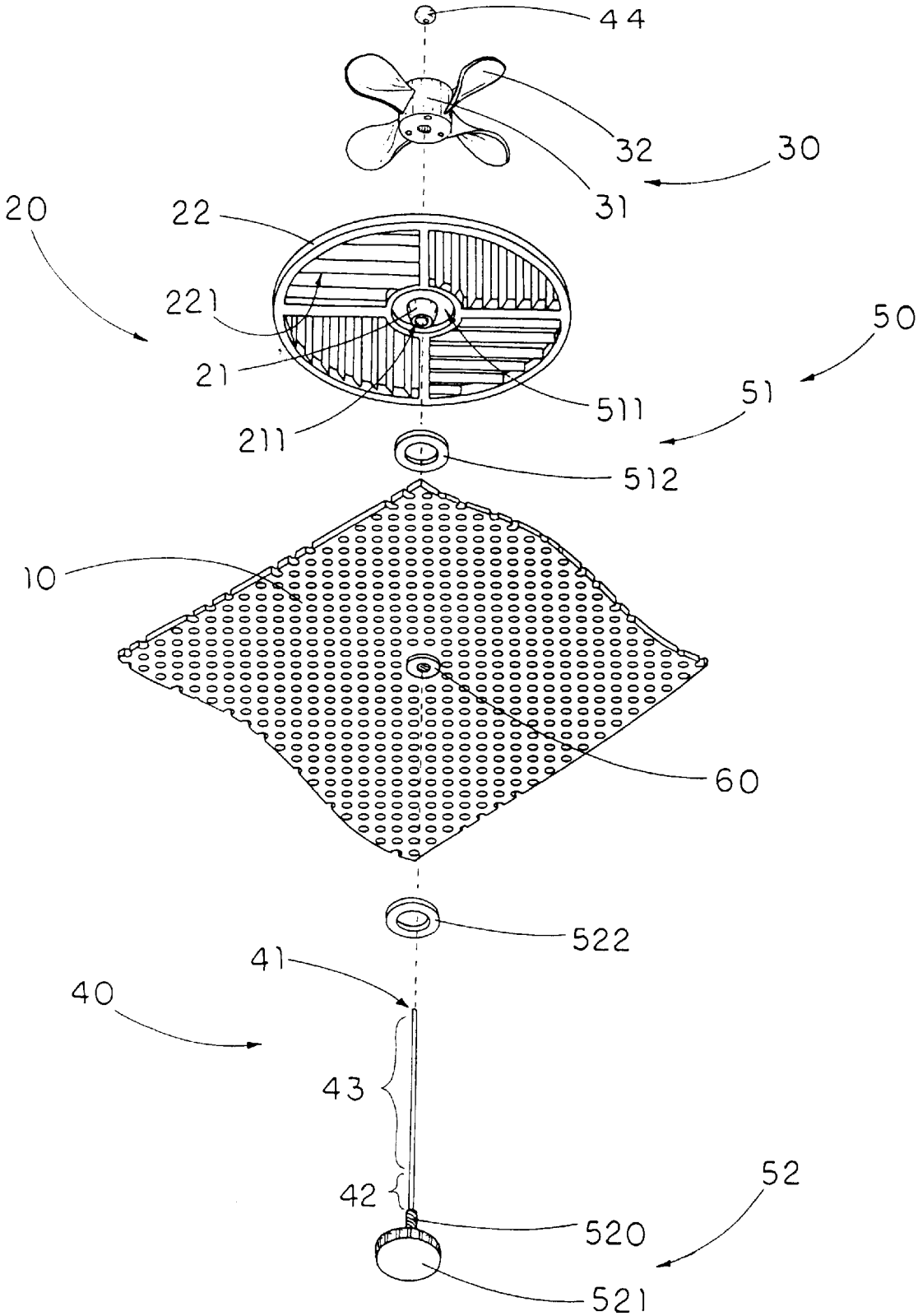
FIG. 1 is an exploded perspective view of an airflow balancer for a ventilation outlet according to a first preferred embodiment of the present invention.

Referring to FIG. 1 of the drawings, an airflow balancer for a ventilation outlet according to a first preferred embodiment of the present invention is illustrated, wherein the ventilation outlet 10, which can be any conventional ventilation outlet, is mounted on a roof, a ceiling or even a wall for exhausting or supplying an airflow A to outside therethrough.

The airflow balancer comprises an air guider 20 comprising a supporter 21 and an airflow baffle 22. The airflow baffle 22 has a plurality of ventilating slots 221 for allowing the airflow A passing through. The supporter 21, which has a rotation ridge 211 downwardly protruded, is provided at a rotation center of the airflow baffle for suspendedly supporting the airflow baffle 22 on the ventilation outlet 10 in a rotatable manner.

The airflow balancer further comprises a rotor 30, such as a propeller fan as shown in FIG. 1, coaxially and upwardly extended from the air guider 20 to form an integral body. The rotor 30 is shaped and sized in such a manner that, in response to the airflow A passing through the rotor 30, the rotor 30 is driven to rotate, so as to drive the air guider 20 to rotate simultaneously. Therefore, such rotational movement of the air guider 20 is adapted for evenly diffusing the airflow A through the ventilating slots 221 toward the ventilation outlet 10.

According to the first preferred embodiment as shown in FIGS. 1 to 3B, the supporter 21 has a hollow cone shape that defines a circular bottom rib as the rotation ridge 211 to rotatably support the airflow baffle 22 on the ventilation outlet 10 in a suspended manner. As shown in FIG. 1, the rotation ridge 211 of the supporter 21 should be made as thin as possible so as to minimize the rotation friction between the rotating air guider 20 and the ventilation outlet 10.

The airflow baffle 22 should be smaller in size than a size of the ventilation outlet 10 wherein the supporter 21 is preferred to be mounted at a center of the airflow baffle 22 in such a manner that when the supporter 21 is mounted on the ventilation outlet 10, the airflow baffle 22 is suspendedly supported on the ventilation outlet 10 in a balance manner. In other words, the supporter 21 is protruded from the airflow baffle 22 in such a manner that the rotation ridge 211 of the supporter 21 is arranged for rotatably supporting on the ventilation outlet 10 in a frictionless movable manner.

It is worth to mention that since the airflow baffle 22 does not in contact with the ventilation outlet 10, no resisting friction will be formed between the airflow baffle 22 and the ventilation outlet 10 to stop the rotation of the airflow baffle 22 accidentally and, moreover, no contacting noise will be generated by the frictional force between the airflow baffle 22 and the ventilation outlet 10.

The airflow baffle 22 has a top side and a bottom side, wherein the ventilating slots 221 is evenly formed on the airflow baffle 22 to communicate the top side with the bottom side of the airflow baffle 22. Each of the ventilating slots 221 is inclinedly extended from the top side to the bottom side of the airflow baffle 22 in such a manner that when the airflow A passes through the ventilating slots 22, the airflow A is guided to evenly spread out towards the ventilation outlet 10 in a circular motion.

As shown in FIG. 1, the rotor 30 comprises a fan body 31 having a central hole and two or more fan blades 32 outwardly and radially extended from the fan body 31.

The fan blades 32 of the rotor 30 are shaped and sized to sufficiently drive the airflow baffle 22 to rotate when the airflow A passes through the fan blades 32.

Accordingly, both the air guider 20 and the rotor 30 are made of lightweight material, such as light wood, plastic, foam material, and etc., in such a manner that the rotor 30 must be as light as being able to be driven to rotate by a general power of airflow A generated by the ventilation system.

The airflow balancer further comprises a supporting shaft 40 to substantially support the air guider 20 on the ventilation outlet 10 in position. The supporting shaft 40 has an upper stopper end 41, a bottom control end portion 42 for rotatably and perpendicularly penetrating through the ventilation outlet 10 to outside, and a shaft body 43 extended between the stopper end 41 and the control end portion 42, wherein the air guider 20 and the rotor 30 are rotatably and coaxially mounted on the shaft body 43 of the supporting shaft 40 so as to retain the air guider 20 and the rotor 30 in position with respect to the ventilation outlet 10. In other words, the airflow baffle 22 is rotated about the supporting shaft 40.

Figure 2:
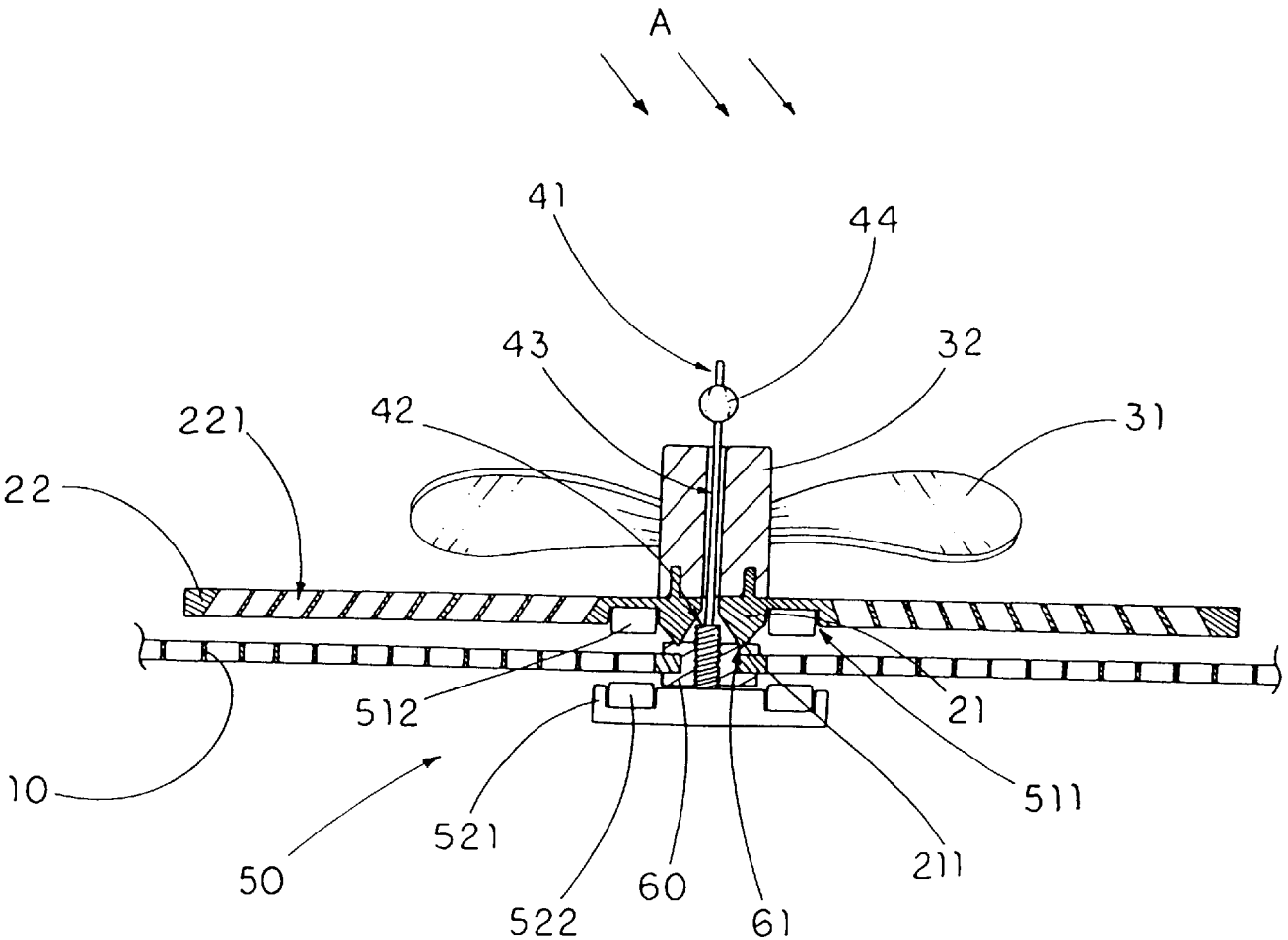
FIG. 2 is a sectional view of the airflow balancer mounted on the ventilation outlet according to the above first preferred embodiment of the present invention.

As shown in FIG. 2, a central hole of the supporter 21 has an inner diameter slightly larger than a diameter of the shaft body 43 of the supporting shaft 40, wherein when the shaft body 43 is rotatably passed through the supporter 21, the airflow baffle 22 is held and supported on top of the ventilation outlet 10 that prevents any unwanted lateral movement of the air guider 20 when the airflow baffle 22 is rotated.

Furthermore, the supporting shaft 40 further comprises a blocking stopper 44, having a ball shaped, securely mounted at the stopper end 41 of the supporting shaft 40 to hold the air guider 20 and the rotor 30 in position and block the rotor 30 from rotatably sliding out of the supporting shaft 40, especially when the rotor 30 is spinning in a relatively high speed, which may drive the rotor 30 moving upwardly.

As shown in FIGS. 1 and 2, the airflow balancer further comprises a holding mount 60, having a ring shaped, for securely mounting on the ventilation outlet 10. The holding mount 60 has a circular guiding groove 61 indented on a top surface of the holding mount 60 to substantially guide the rotational movement of the supporter 21 on the holding mount 60, wherein the circular rotation ridge 211 of the supporter 21 is rotatably sit in the guiding groove 60 to guide the rotation of air guider 20 and the rotor 30.

As shown in FIG. 1, the airflow balancer further comprises a speed control arrangement 50 to adjustably control a speed of the rotational movement of the airflow baffle 22. The speed control arrangement 50 comprises a magnetic holder 51 being provided at the airflow baffle 22 and a magnetic seat 52 integrally connected to the control portion 42 of the supporting shaft 40 to engage with the holding mount 60 wherein the magnetic seat 52 is arranged to align with the magnetic holder 51 to adjustably control the speed of the rotational movement of the airflow baffle 22 by means of magnetic force.

Accordingly, the magnetic seat 52 further comprises a central hub 520 upwardly extended therefrom wherein the central hub 520 has an outer threaded section engaged with an inner threaded section of the holding mount 60 in such a manner that the supporting shaft 40 is adapted to be supported by the holding mount 60, so as to selectively adjust a distance between the magnetic holder 51 and the magnetic seat 52.

Figure 3A:
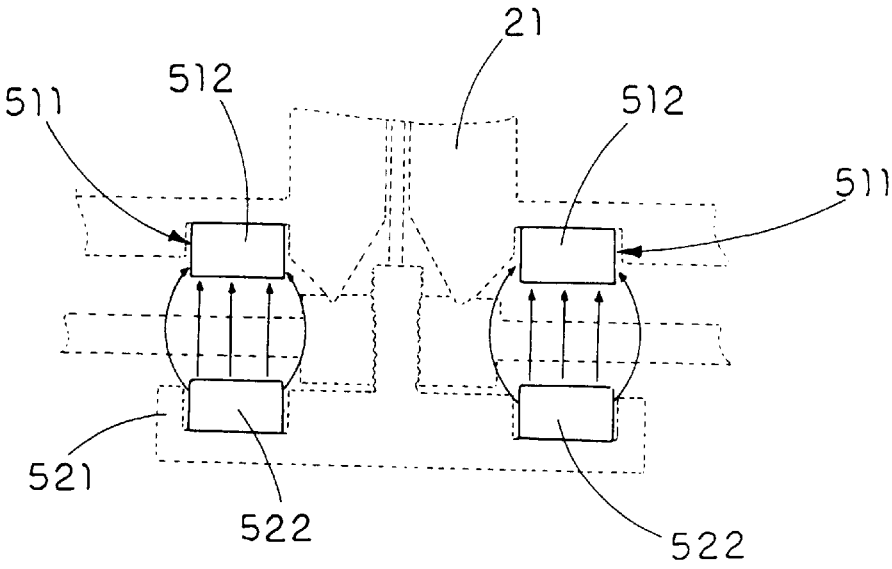
FIG. 3A is a partially sectional view of the airflow balancer according to the above first preferred embodiment of the present invention, illustrating the magnetic attraction of the speed control arrangement.

According to the first preferred embodiment, the magnetic seat 52 comprises a magnetic housing 521 made of non-magnetic material and a ring-shaped magnet 522 mounted in the magnetic housing 521 and arranged to provide a magnetic attraction force to the magnetic holder 51. Symmetrically, the magnetic holder 51 has a magnetic socket 511 provided on the airflow baffle 22 and comprises a ring-shaped magnetic element 512 mounted in the magnetic socket 511, wherein the magnetic element 512 has a bottom pole opposite to a top pole of the magnet 522 that confronts the bottom pole of the magnetic element 512. Due to the magnetic theory of "Like poles attract; Unlike poles repel", the opposite bottom and top poles of the magnetic element 512 and the magnet 522 will produce the magnetic attraction force therebetween, as shown in FIG. 3A.

In order words, when the magnetic seat 52 is moved towards the magnetic holder 51, the magnetic attraction force therebetween will be increased that substantially reduces the rotation speed of the airflow baffle 22. It is because the magnetic attraction force pulls the supporter 21 downwardly toward the magnetic seat 51 so as to increase the resisting frictional force and the magnetic attraction force between the rotation ridge 211 of the supporter 21 and the ventilation outlet 10. Therefore, the rotational movement of the airflow baffle 22 is substantially slowed down or even stopped.

Likewise, when the magnetic seat 52 is rotatably moved away from the magnetic holder 51, the magnetic attraction force will be substantially reduced, so as to increase the speed of the airflow baffle 22 by means of reducing the frictional force.

Figure 3B:
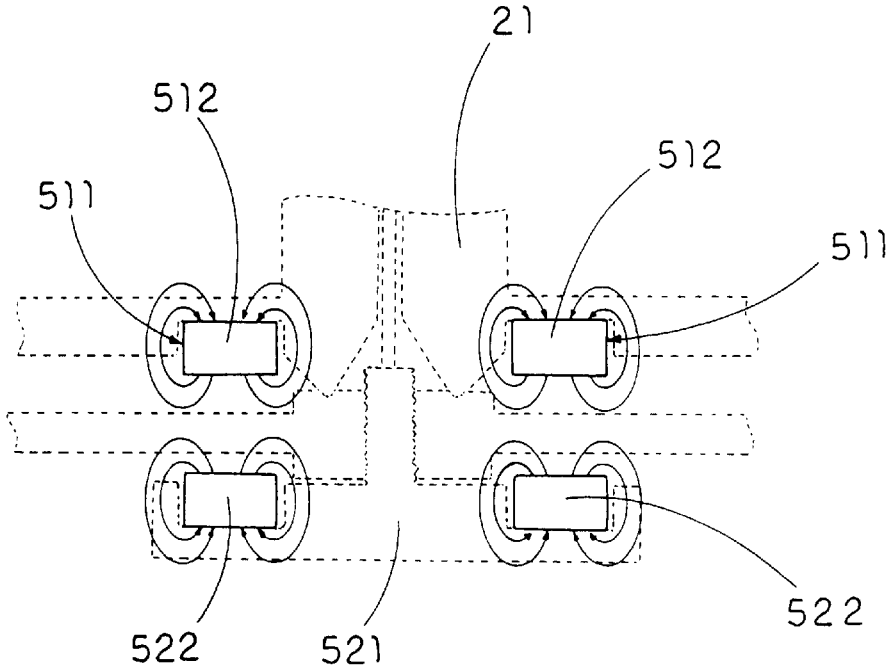
FIG. 3B illustrates an alternative mode of the speed control arrangement of the airflow balancer according to the above first preferred embodiment of the present invention.

Alternatively, the bottom pole of the magnet element 512 and the top pole of the magnet 522 are the same that provides a magnetic repelling force therebetween. Therefore, when the magnetic seat 52 is rotatably moved towards the magnetic holder 51 to substantially increase the magnetic repelling force, the magnetic repelling force will push the supporter 21 upwardly to reduce the frictional force between the rotation ridge 211 of the supporter 21 and the ventilation outlet 10 that renders the air guider 20 rotatably floating about the holding mount 60 and thus increases the rotation speed of the airflow baffle 22, as shown in FIG. 3B.

In other words, when the magnetic seat 52 is moved away from the magnetic holder 51, the magnetic repelling force therebetween will be substantially reduced and thus the frictional force between the rotation ridge 211 of the supporter 21 and the ventilation outlet 10 will be substantially increased, so as to reduce the rotation speed of the airflow baffle 22.

Figure 4:
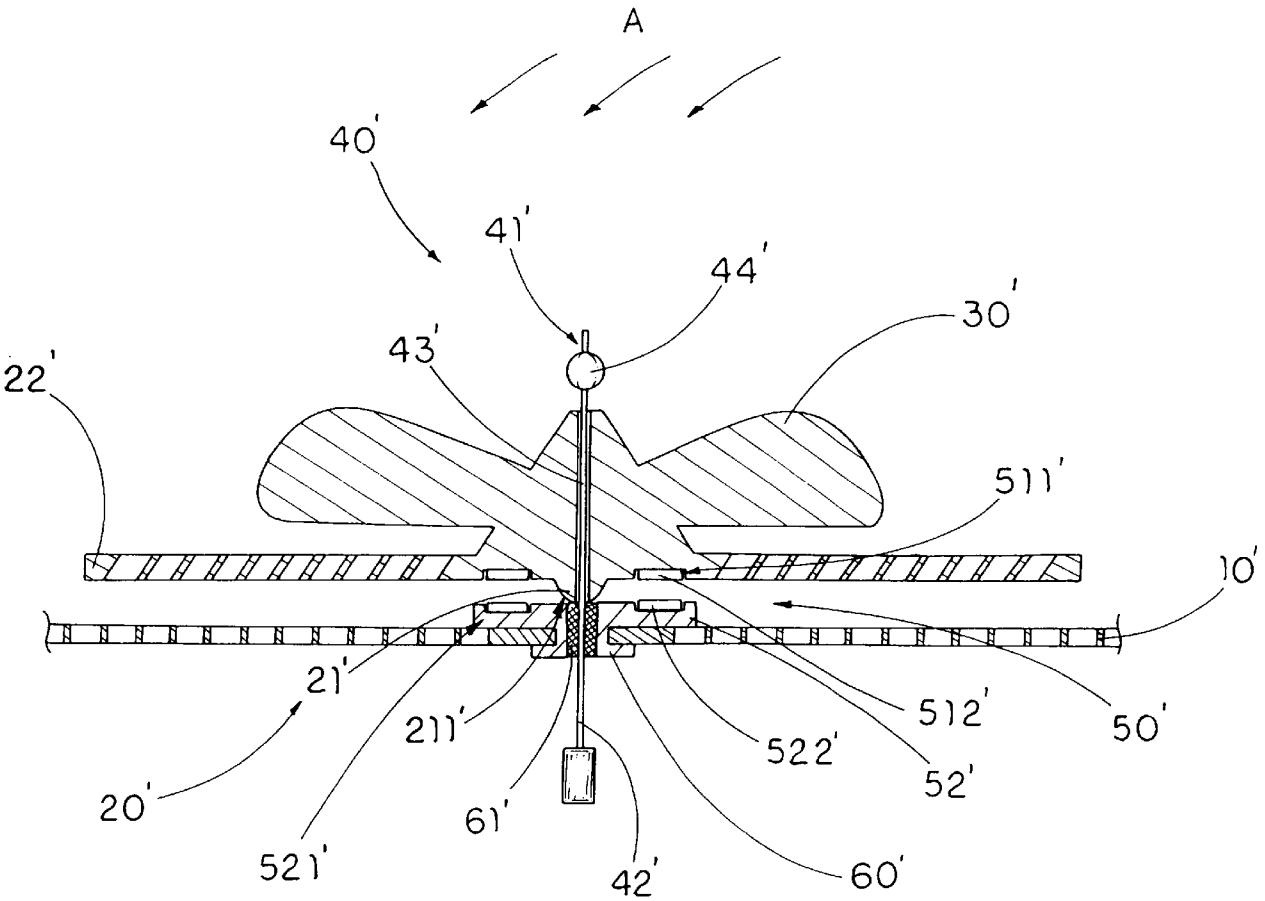
FIG. 4 is a sectional view of an airflow balancer for a ventilation outlet according to a second preferred embodiment of the present invention.

As shown in FIG. 4, a second embodiment of the airflow balancer illustrates an alternative mode of the present invention, wherein the rotor 30" is coaxially connected on top of the air guider 20' to form a one-piece integral body.

According to the second embodiment, the supporter 21' is embodied to form a semi-spherical shape so as to provide a round-shaped rotation ridge 211' which is capable of minimizing the frictional force of supporter 21' when the airflow baffle 22',which also has a plurality of ventilating slots 221' provided therethrough, is driven to rotate, so as to enhance the rotational movement of the air guider 20'.

Moreover, the supporting shaft 40' is shaped and sized as a pin-like elongated member, wherein the supporting shaft 40' also has an upper stopper end 41' where the blocking stopper 44' is slibably mounted thereon to block the rotor 30' from sliding out of the supporting shaft 40', a bottom control end portion 42' rotatably extended through the ventilation outlet 10' to outside, and a shaft body 43' extended between the stopper end 41' and the control end portion 42'. The supporter 21' of the air guider 20' and the rotor 30' are mounted on the shaft body 43' in a free rotatable manner. Therefore, the supporting shaft 40 is capable of supporting the air guider 20' and the rotor 30' in position with respect to the ventilation outlet 10' while permitting the airflow baffle 22' to rotate about the supporting shaft 40'.

Figure 5:
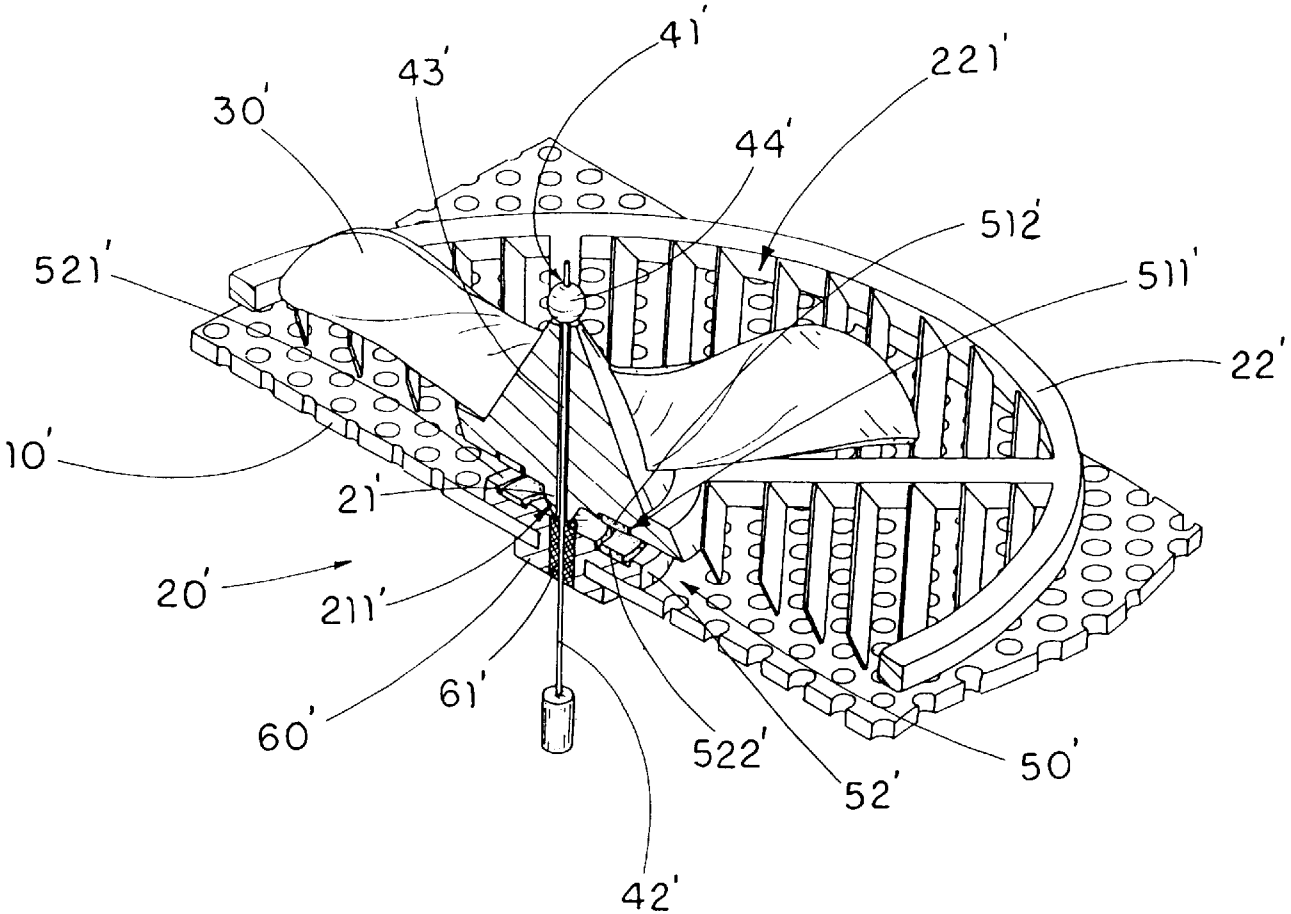
FIG. 5 is a sectional perspective view of the airflow balancer mounted on the ventilation outlet according to the above second preferred embodiment of the present invention.

As shown in FIGS. 4 and 5, the airflow balancer of the second preferred embodiment also comprises a rigid holding mount 60' securely mounted on the ventilation outlet 10'. The holding mount 60' has an I-shaped cross section and a central hole integrally implanted with a holding member 61' which is made of rubber or the like. The supporting shaft 40' is axially and slidably penetrated through the holding member 61'. Accordingly, since the holding member 60' is made of material having high friction coefficient such as rubber, the holding member 61' is adapted to hold the supporting shaft 40' in position by means of friction, along which air guider 20' and the rotor 30' are rotatably supported in position. Moreover, the holding member 61' provides a round top surface to ensure a point contacting support with the round rotation ridge 211' of the supporter 21' so as to further reduce the frictional force therebetween.

The airflow balance of the second preferred embodiment also comprises a speed control arrangement 50' to adjustably control a speed of the rotational movement of the airflow baffle 22'. The speed control arrangement 50' also comprises a magnet holder 51 which is provided at a center portion of a bottom side of the air baffle 22' and has a magnetic attraction ability provided at the airflow baffle 22', and a magnetic seat 52', which is embodied as the top holding piece of holding mount 60' according to the second preferred embodiment, being adapted for mounting to the ventilation outlet 10' to rotatably support the supporter 21', wherein the magnetic seat 52' is arranged to align and confront with the magnetic holder 51' to adjustably control the speed of the rotational movement of the airflow baffle 22' by means of magnetic force.

The magnetic seat 52' has a magnetic housing 521' made of non-magnetic material and a ring-shaped magnet 522' is mounted in the magnetic housing 521' and arranged to provide a magnetic repelling force to the magnetic holder 51'. Symmetrically, the magnetic holder 51' has a magnetic socket 511' provided on the center portion of the bottom side of the airflow baffle 22' and comprises a ring-shaped magnetic element 512' mounted in the magnetic socket 511'.

Figure 6A:
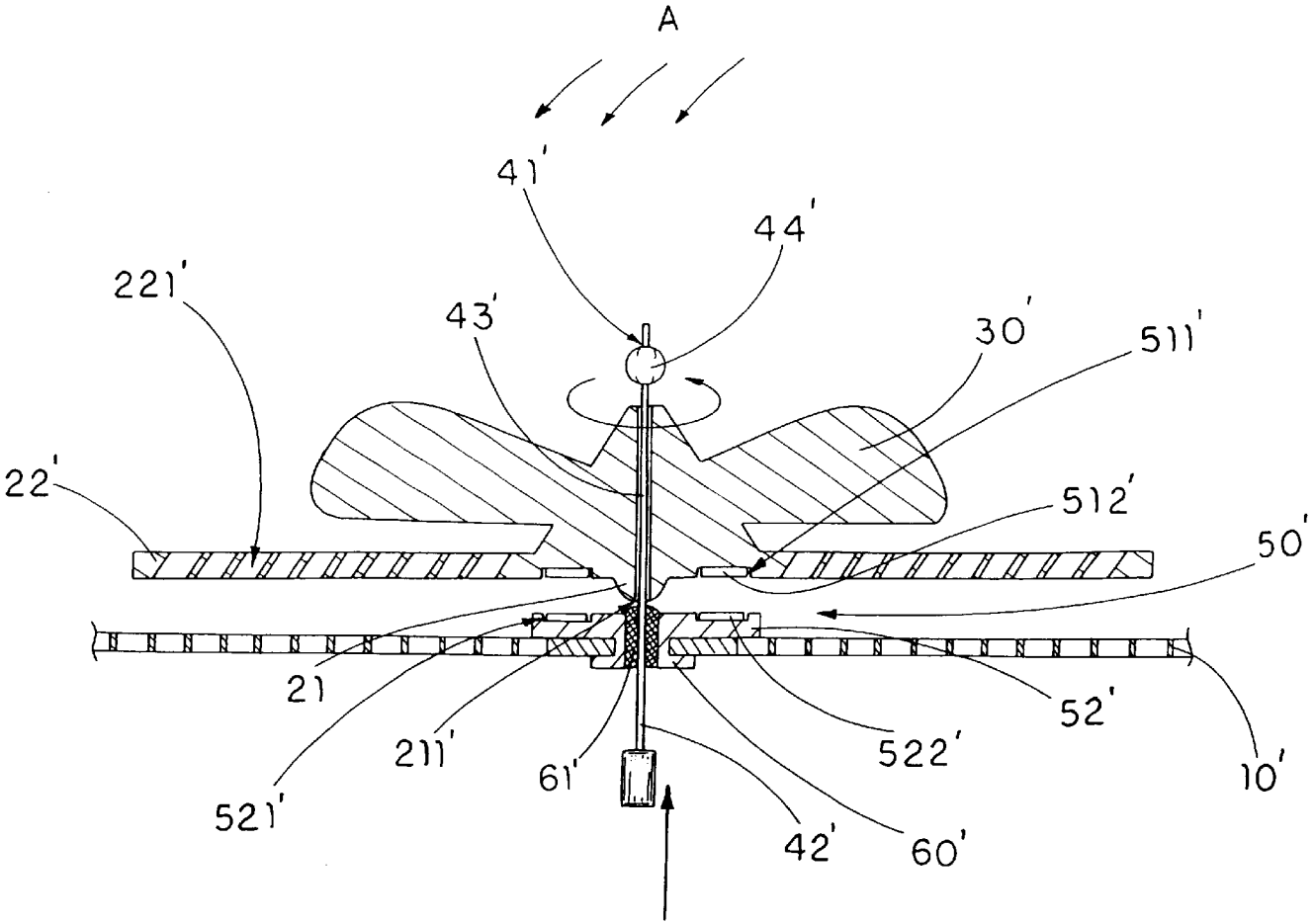
FIG. 6A illustrates an operation of the airflow balancer according to the above second preferred embodiment of the present invention, illustrating the airflow baffle rotating in a suspended manner.

According to the second preferred embodiment, the magnet element 512' received in the magnet socket 511' has a bottom pole same as a top pole of the magnet 522' received in the magnetic housing 521' while the magnet element 512' confronts with the magnet 522' so as to provide a magnetic repelling force therebetween. Due to the magnetic repelling force, the integral body of the air guider 21' and the rotor 30' is pushed upwardly with respect to the ventilation outlet 10' that substantially reduces the frictional force between the rotation ridge 211' of the supporter 21' and the magnetic seat 52' so as to further enhance the rotational movement of the airflow baffle 22'. In other words, the air baffle 22' is induced to rotatably float about the holding mount 60' of the ventilation outlet 10', as shown in FIG. 6A, due to the magnetic repelling force.

Since the airflow baffle 22' is suspendedly supported on the air ventilation outlet 10' by the magnetic repelling force, the frictional force between the rotation ridge 211' of the supporter 21' and the magnetic seat 52' is minimized so as to increase the rotation speed of the airflow baffle 22'. When the airflow baffle 22' is in rotation, the magnetic repelling force between the magnet element 512' and the magnet 522' and the centrifugal force of the rotating air baffle 22' render the light-weight air guider 20' and the rotor 30' floating above the magnetic seat 52' and the holding mount 60' to further ensure the round rotation ridge 211' of the supporter 21' to have no contact with the round top surface of the holding member 61', so as to further increase the rotation speed of the airflow baffle 22'.

Figure 6B:
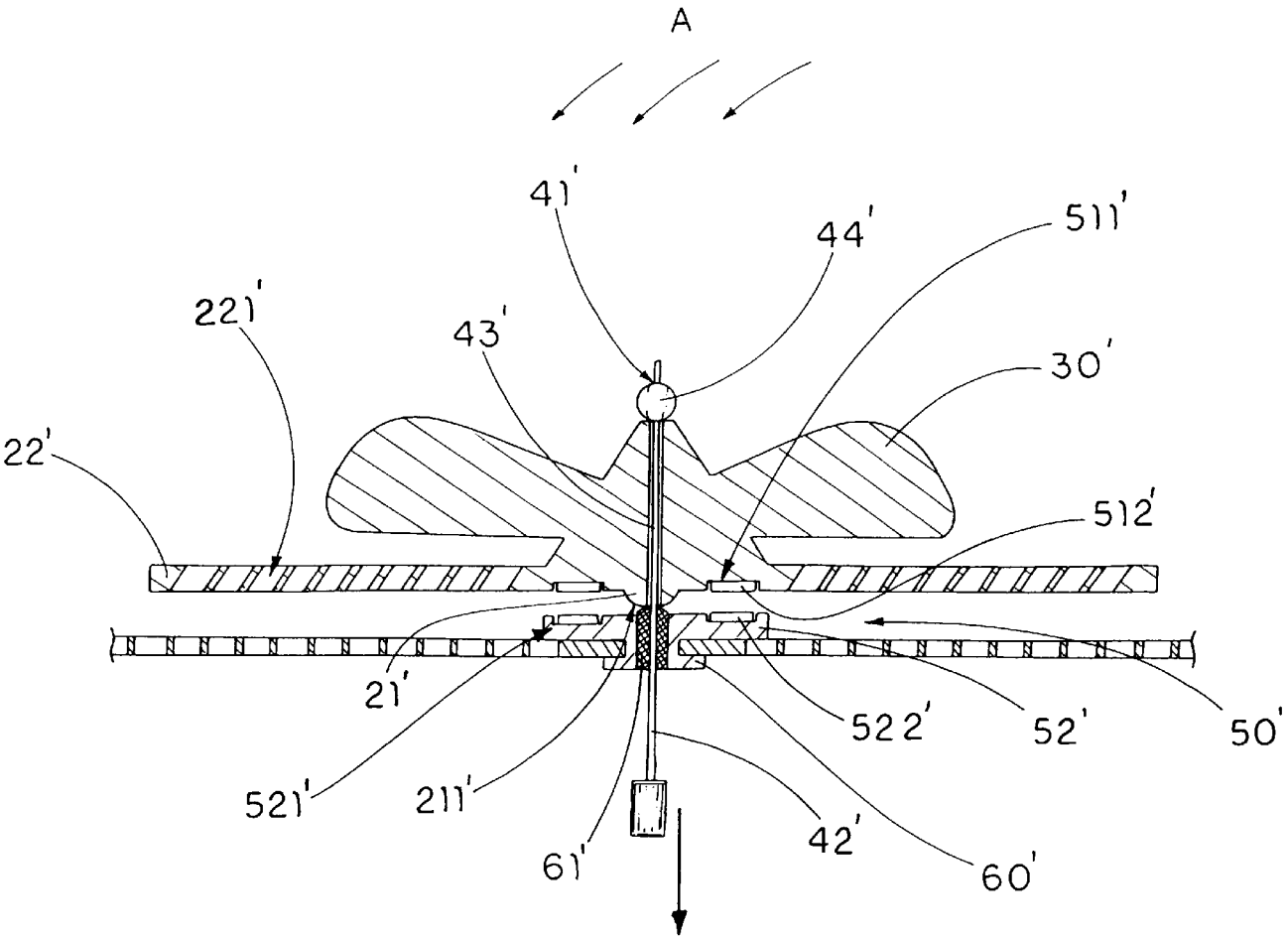
FIG. 6B illustrates an operation of the airflow balancer according to the above second preferred embodiment of the present invention, illustrating the airflow baffle rotating frictionally.

In order to control the speed of the airflow baffle 22', a downward force can be applied on the control end portion 42' of the supporting shaft 40' to pull the blocking stopper 44' at the stopper end 41' of supporting shaft 40' downwardly in such a manner that the blocking stopper 44' will be pulled to bias against the rotor 30' so as to pull the air guider 20' downwardly so as to drive the rotation ridge 211' of the supporter 21' to bias against the magnetic seat 52' under a predetermined compression pressure, as shown in FIG. 6B.

Therefore, the user is able to selectively apply the downward force to adjust the position of the blocking stopper 44'. When the blocking stopper 44' is pulled downwardly, two frictional forces are generated to reduce the speed of the airflow baffle 22' wherein the first frictional force is produced between the blocking stopper 44' and the rotor 30' and the second frictional force is produced between the rotation ridge 211' of the supporter 21' and the magnetic seat 52'. Therefore, the two frictional forces will substantially reduce or even stop the rotational movement of the airflow baffle 22'.

When an upward force is applied on the control end portion 42' of the supporting shaft 40' to drive the blocking stopper 44' moving upwardly, the magnetic repelling force will push the air guider 20' to rotatably float up with respect to the guiding mount 60'. Therefore, the frictional force between the rotation ridge 211' of the supporter 21' and the magnetic seat 52' will be reduced to speed up the rotational movement of the airflow baffle 22'. It is worth mentioning that since the holding member 523' will hold the supporting shaft 40' in position, the supporting shaft 40' will not be accidentally drop down when the supporting shaft 40' is pushed to an upper position.

While the foregoing description and diagram describe the preferred embodiment and its alternatives, it should be appreciated that certain obvious modifications, variations, and substitutions may be made without departing from the spirit and scope of the present invention. For example, a ball bearing can be incorporated with the air guider 20, 20' in order to enhance the smooth rotational movement of the air guider 20, 20'. Moreover, the airflow baffle 22, 22' can be made of non-magnetic material or soft-magnetic metal having magnetic attraction ability so as to enhance the magnetic attraction or repel between the magnetic holder 51, 51' and the magnetic seat 52, 52'.

What is claimed is:

1. An airflow balancer for a ventilation outlet, comprising:

an air guider comprising an airflow baffle having a plurality of ventilating slots for allowing an airflow passing through and a supporter which is provided at a rotation center of said airflow baffle for supporting said airflow baffle on said ventilation outlet in a rotatable manner without any physical contact with said ventilation outlet; and a rotor coaxially and upwardly extended from said air guider to form an integral body, wherein said rotor is shaped and sized in such manner that, in response to said airflow passing through said rotor, said rotor is driven to rotate, so as to drive said air guider to rotate, thereby a rotational movement of said air guider is adapted for evenly diffusing said airflow through said ventilating slots toward said ventilation outlet.

2. The airflow balancer, as recited in claim 1, wherein said supporter has a rotation ridge downwardly protruded to rotatably support said airflow baffle on said ventilation outlet in a suspended manner for minimizing a rotation friction between said rotating air guider and said ventilation outlet.

3. The airflow balancer, as recited in claim 1, wherein said supporter has a hollow cone shape that defines a circular bottom rib to form a rotation ridge for rotatably supporting said airflow baffle on said ventilation outlet in a suspended manner for minimizing a rotation friction between said rotating air guider and said ventilation outlet.

4. The airflow balancer, as recited in claim 2, further comprising a holding mount for securely mounting on said ventilation outlet, wherein said holding mount has a circular guiding groove indented on a top surface thereof, wherein said rotation ridge of said supporter is rotatably sit in said guiding groove to guide said rotation of air guider and said rotor.

5. The airflow balancer, as recited in claim 3, further comprising a holding mount for securely mounting on said ventilation outlet, wherein said holding mount has a circular guiding groove indented on a top surface thereof, wherein said rotation ridge of said supporter is rotatably sit in said guiding groove to guide said rotation of air guider and said rotor.

6. The airflow balancer, as recited in claim 1, further comprising a speed control arrangement to adjustably control a speed of said rotational movement of said airflow baffle.

7. The airflow balancer, as recited in claim 4, further comprising a speed control arrangement to adjustably control a speed of said rotational movement of said airflow baffle.

8. The airflow balancer, as recited in claim 5, further comprising a speed control arrangement to adjustably control a speed of said rotational movement of said airflow baffle.

9. The airflow balancer, as recited in claim 7, wherein said speed control arrangement comprises a magnetic holder being provided at said airflow baffle and a magnetic seat integrally connected to said control portion of said supporting shaft to engage with said holding mount wherein said magnetic seat is arranged to align with said magnetic holder to adjustably control said speed of said rotational movement of said airflow baffle by means of magnetic force.

10. The airflow balancer, as recited in claim 8, wherein said speed control arrangement comprises a magnetic holder being provided at said airflow baffle and a magnetic seat integrally connected to said control portion of said supporting shaft to engage with said holding mount wherein said magnetic seat is arranged to align with said magnetic holder to adjustably control said speed of said rotational movement of said airflow baffle by means of magnetic force.

11. The airflow balancer, as recited in claim 9, wherein said magnetic housing is made of non-magnetic material and a ring-shaped magnet is mounted in said magnetic housing and arranged to provide a magnetic attraction force to said magnetic holder, moreover, symmetrically, said magnetic holder has a magnetic socket provided on said airflow baffle and comprises a magnetic element mounted in said magnetic socket.

12. The airflow balancer, as recited in claim 10, wherein said magnetic housing is made of non-magnetic material and a ring-shaped magnet is mounted in said magnetic housing and arranged to provide a magnetic attraction force to said magnetic holder, moreover, symmetrically, said magnetic holder has a magnetic socket provided on said airflow baffle and comprises a magnetic element mounted in said magnetic socket.

13. The airflow balancer, as recited in claim 11, wherein said magnetic element has a bottom pole opposite to a top pole of said magnet that confronts said bottom pole of said magnetic element.

14. The airflow balancer, as recited in claim 12, wherein said magnetic element has a bottom pole opposite to a top pole of said magnet that confronts said bottom pole of said magnetic element so as to provide a magnetic attraction force therebetween.

15. The airflow balancer, as recited in claim 11, wherein a bottom pole of said magnet element and a top pole of said magnet are said same that provides a magnetic repelling force therebetween.

16. The airflow balancer, as recited in claim 12, wherein a bottom pole of said magnet element and a top pole of said magnet are said same that provides a magnetic repelling force therebetween.

17. The airflow balancer, as recited in claim 2, further comprising a supporting shaft to substantially support said air guider on said ventilation outlet in position, wherein said supporting shaft has an upper stopper end, a bottom control end portion for rotatably and perpendicularly penetrating through said ventilation outlet to outside, and a shaft body extended between said stopper end and said control end portion, wherein said air guider and said rotor are rotatably and coaxially mounted on said shaft body of said supporting shaft so as to retain-said air guider and said rotor in position with respect to said ventilation outlet and enable said airflow baffle to be rotated about said supporting shaft.

18. The airflow balancer, as recited in claim 17, said supporting shaft further comprises a blocking stopper securely mounted at said stopper end of said supporting shaft to hold said air guider and said rotor in position and block said rotor from rotatably sliding out of said supporting shaft.

19. The airflow balancer, as recited in claim 11, further comprising a supporting shaft to substantially support said air guider on said ventilation outlet in position, wherein said supporting shaft has an upper stopper end, a bottom control end portion for rotatably and perpendicularly penetrating through said ventilation outlet to outside, and a shaft body extended between said stopper end and said control end portion, wherein said air guider and said rotor are rotatably and coaxially mounted on said shaft body of said supporting shaft so as to retain said air guider and said rotor in position with respect to said ventilation outlet and enable said airflow baffle to be rotated about said supporting shaft.

20. The airflow balancer, as recited in claim 19, said supporting shaft further comprises a blocking stopper provided at said stopper end of said supporting shaft to hold said air guider and said rotor in position and block said rotor from rotatably sliding out of said supporting shaft.

21. The airflow balancer, as recited in claim 19, wherein said magnetic seat further comprises a central hub upwardly extended therefrom wherein said central hub has an outer threaded section engaged with an inner threaded section of said holding mount in such a manner that said supporting shaft is adapted to be supported by said holding mount, so as to selectively adjust a distance between said magnetic holder and said magnetic seat.

22. The airflow balancer, as recited in claim 12, further comprising a supporting shaft to substantially support said air guider on said ventilation outlet in position, wherein said supporting shaft has an upper stopper end, a bottom control end portion for rotatably and perpendicularly penetrating through said ventilation outlet to outside, and a shaft body extended between said stopper end and said control end portion, wherein said air guider and said rotor are rotatably and coaxially mounted on said shaft body of said supporting shaft so as to retain said air guider and said rotor in position with respect to said ventilation outlet and enable said airflow baffle to be rotated about said supporting shaft.

23. The airflow balancer, as recited in claim 22, said supporting shaft further comprises a blocking stopper provided at said stopper end of said supporting shaft to hold said air guider and said rotor in position and block said rotor from rotatably sliding out of said supporting shaft.

24. The airflow balancer, as recited in claim 22, wherein said magnetic seat further comprises a central hub upwardly extended therefrom wherein said central hub has an outer threaded section engaged with an inner threaded section of said holding mount in such a manner that said supporting shaft is adapted to be supported by said holding mount, so as to selectively adjust a distance between said magnetic holder and said magnetic seat.

25. The airflow balancer, as recited in claim 1, wherein said rotor is coaxially connected on top of said air guider to form an one-piece integral body and said rotor and said air guider are made of light weight material.

26. The airflow balancer, as recited in claim 2, further comprising a holding mount for securely mounting on said ventilation outlet, wherein said rotation ridge of said supporter is rotatably sit on top thereof to guide said rotation of said air guider and said rotor.

27. The airflow balancer, as recited in claim 26, wherein said rotation ridge of said supporter is in a semi-spherical shape so as to minimize a frictional force of said supporter when said airflow baffle is driven to rotate.

28. The airflow balancer, as recited in claim 26, further comprising a supporting shaft to support said air guider on said ventilation outlet in position through said holding mount, wherein said supporter of said air guider and said rotor are mounted on said shaft body in a free rotatable manner.

29. The airflow balancer, as recited in claim 27, further comprising a supporting shaft to support said air guider on said ventilation outlet in position through said holding mount, wherein said supporter of said air guider and said rotor are mounted on said shaft body in a free rotatable manner.

30. The airflow balancer, as recited in claim 28, wherein said supporting shaft, which is shaped and sized as a pin-like elongated member, has an upper stopper end where a blocking stopper is slibably mounted thereon to block said rotor from sliding out of said supporting shaft, a bottom control end portion rotatably-extended through said ventilation outlet to outside, and a shaft body extended between said stopper end and said control end portion, thereby said supporting shaft is capable of supporting said air guider and said rotor in position with respect to said ventilation outlet while permitting said airflow baffle to rotate about said supporting shaft.

31. The airflow balancer, as recited in claim 29, wherein said supporting shaft, which is shaped and sized as a pin-like elongated member, has an upper stopper end where a blocking stopper is slibably mounted thereon to block said rotor from sliding out of said supporting shaft, a bottom control end portion rotatably extended through said ventilation outlet to outside, and a shaft body extended between said stopper end and said control end portion, thereby said supporting shaft is capable of supporting said air guider and said rotor in position with respect to said ventilation outlet while permitting said airflow baffle to rotate about said supporting shaft.

32. The airflow balancer, as recited in claim 28, wherein said holding mount which is adapted for securely mounting on said ventilation outlet, has a central hole integrally implanted with a holding member, wherein said supporting shaft is axially and slidably penetrated through said holding member for supporting said air guider and rotor in position on said ventilation outlet, wherein said holding member is made of elastic material having a high friction coefficient for holding said supporting shaft in position by means of friction, along which said air guider and said rotor are rotatably supported in position.

33. The airflow balancer, as recited in claim 27, wherein said holding member provides a round top surface to ensure a point contacting support with said round rotation ridge of said supporter.

34. The airflow balancer, as recited in claim 32, wherein said rotation ridge of said supporter is in a semi-spherical shape and said holding member provides a round top surface to ensure a point contacting support with said round rotation ridge of said supporter so as to minimize a frictional force of said supporter when said airflow baffle is driven to rotate.

35. The airflow balancer, as recited in claim 30, wherein said holding mount which is adapted for securely mounting on said ventilation outlet, has a central hole integrally implanted with a holding member, wherein said supporting shaft is axially and slidably penetrated through said holding member for supporting said air guider and rotor in position on said ventilation outlet, wherein said holding member is made of elastic material having a high friction coefficient for holding said supporting shaft in position by means of friction, along which said air guider and said rotor are rotatably supported in position.

36. The airflow balancer, as recited in claim 35, wherein said rotation ridge of said supporter is in a semi-spherical shape and said holding member provides a round top surface to ensure a point contacting support with said round rotation ridge of said supporter so as to minimize a frictional force of said supporter when said airflow baffle is driven to rotate.

37. The airflow balancer, as recited in claim 26, further comprising a speed control arrangement to adjustably control a speed of said rotational movement of said airflow baffle.

38. The airflow balancer, as recited in claim 30, further comprising a speed control arrangement to adjustably control a speed of said rotational movement of said airflow baffle.

39. The airflow balancer, as recited in claim 31, further comprising a speed control arrangement to adjustably control a speed of said rotational movement of said airflow baffle.

40. The airflow balancer, as recited in claim 32, further comprising a speed control arrangement to adjustably control a speed of said rotational movement of said airflow baffle.

41. The airflow balancer, as recited in claim 34, further comprising a speed control arrangement to adjustably control a speed of said rotational movement of said airflow baffle.

42. The airflow balancer, as recited in claim 35, further comprising a speed control arrangement to adjustably control a speed of said rotational movement of said airflow baffle.

43. The airflow balancer, as recited in claim 36, further comprising a speed control arrangement to adjustably control a speed of said rotational movement of said airflow baffle.

44. The airflow balancer, as recited in claim 37, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

45. The airflow balancer, as recited in claim 38, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

46. The airflow balancer, as recited in claim 39, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

47. The airflow balancer, as recited in claim 40, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

48. The airflow balancer, as recited in claim 41, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

49. The airflow balancer as recited in claim 43, wherein said speed control arrangement comprises a magnet holder which is provided at a center portion of a bottom side of the air baffle and has a magnetic attraction ability provided at said airflow baffle, and a magnetic seat, which is a top holding piece of said holding mount for mounting to said ventilation outlet to rotatably support said supporter, wherein said magnetic seat is arranged to align and confront with said magnetic holder to adjustably control a speed of said rotational movement of said airflow baffle by means of magnetic force.

50. The airflow balancer, as recited in claim 44, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

51. The airflow balancer, as recited in claim 45, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

52. The airflow balancer, as recited in claim 46, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

53. The airflow balancer, as recited in claim 47, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

54. The airflow balancer, as recited in claim 48, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

55. The airflow balancer, as recited in claim 49, wherein said magnetic seat has a magnetic housing made of non-magnetic material and a magnet is mounted in said magnetic housing and arranged to provide a magnetic repelling force to said magnetic holder, moreover, symmetrically, said magnetic holder has a magnetic socket provided on said center portion of said bottom side of said airflow baffle and comprises a magnetic element mounted in said magnetic socket, wherein said magnet element received in said magnet socket has a bottom pole same as a top pole of said magnet received in said magnetic housing while said magnet element confronts with said magnet so as to provide a magnetic repelling force therebetween for suspendedly supporting said airflow baffle on said ventilation outlet while said frictional force between said rotation ridge of said supporter and said magnetic seat is minimized.

* * * * *